US005221024A

United States Patent [19]

Campbell

[11] Patent Number: 5,221,024

[45] Date of Patent: Jun. 22, 1993

[54] PROGRAMMABLE MEDICINE DISPENSER WITH MANUAL OVERRIDE AND COLOR CODED MEDICINE CANISTERS

[76] Inventor: Gordon M. Campbell, 17700 Highway 101, Willits, Calif. 95490

[21] Appl. No.: 992,992

[22] Filed: Dec. 18, 1992

[51] Int. Cl.[5] ..... G07F 11/46

[52] U.S. Cl. ..... 221/3; 221/15; 221/312 C

[58] Field of Search ..... 206/534; 221/2, 3, 7, 221/8, 15, 16, 17, 22, 66, 154, 155, 312 C

[56] References Cited

U.S. PATENT DOCUMENTS

| | | | |
|---|---|---|---|
| 3,369,697 | 2/1968 | Glucksman et al. | 221/9 |
| 3,563,410 | 2/1971 | Murray | 221/1 |
| 3,752,359 | 8/1973 | Shaw | 221/5 |
| 4,223,801 | 9/1980 | Carlson | 221/15 X |
| 4,310,103 | 1/1982 | Reilly et al. | 221/15 |
| 4,382,688 | 5/1983 | Machamer | 221/2 X |
| 4,473,156 | 9/1984 | Martin | 206/534 |
| 4,473,884 | 9/1984 | Behl | 221/3 X |
| 4,573,606 | 3/1986 | Lewis et al. | 221/2 |
| 4,663,621 | 5/1987 | Field et al. | 221/2 X |
| 4,674,651 | 6/1987 | Scidmore et al. | 221/3 |
| 4,717,042 | 1/1988 | McLaughlin | 221/15 X |
| 4,731,765 | 3/1988 | Cole et al. | 368/10 |
| 4,763,810 | 8/1988 | Christiansen | 221/15 X |
| 4,872,591 | 10/1989 | Konopka | 221/15 X |
| 4,911,327 | 3/1990 | Shepherd et al. | 221/3 |
| 5,152,422 | 10/1992 | Springer | 221/2 |

*Primary Examiner*—Robert P. Olszewski
*Assistant Examiner*—Dean A. Reichard

[57] ABSTRACT

A programmable medicine dispenser with manual override and color coded medicine canisters comprises a cabinet with a spring loaded door. A vertical magazine with a top loading port and a bottom dispensing port holds a large number of medicine canisters each containing medicine to be taken at one time. The canisters are divided into groups, each group identified by colored patches on the canisters corresponding to the scheduled doses during a day. The door is normally locked by an electro-mechanical latching mechanism to prevent access to the medicine. A programmable electronic timer is set to operate the latching mechanism to unlock the door at selectable times during the day, such that the canisters may be sequentially accessed and the medicine taken in the proper order. When the door is unlocked, it springs open to release a lever switch to activate a lamp and a buzzer to alert the patient or a caretaker that medicine should be taken at that time. An override pin is located under the latching mechanism, and is operable from the outside of the cabinet. The pin allows the manual operation of the mechanism independently of the timer, such that the medication may be accessed during emergencies. An override lockout bar is provided for optionally disabling the override pin as a child safety measure.

20 Claims, 3 Drawing Sheets

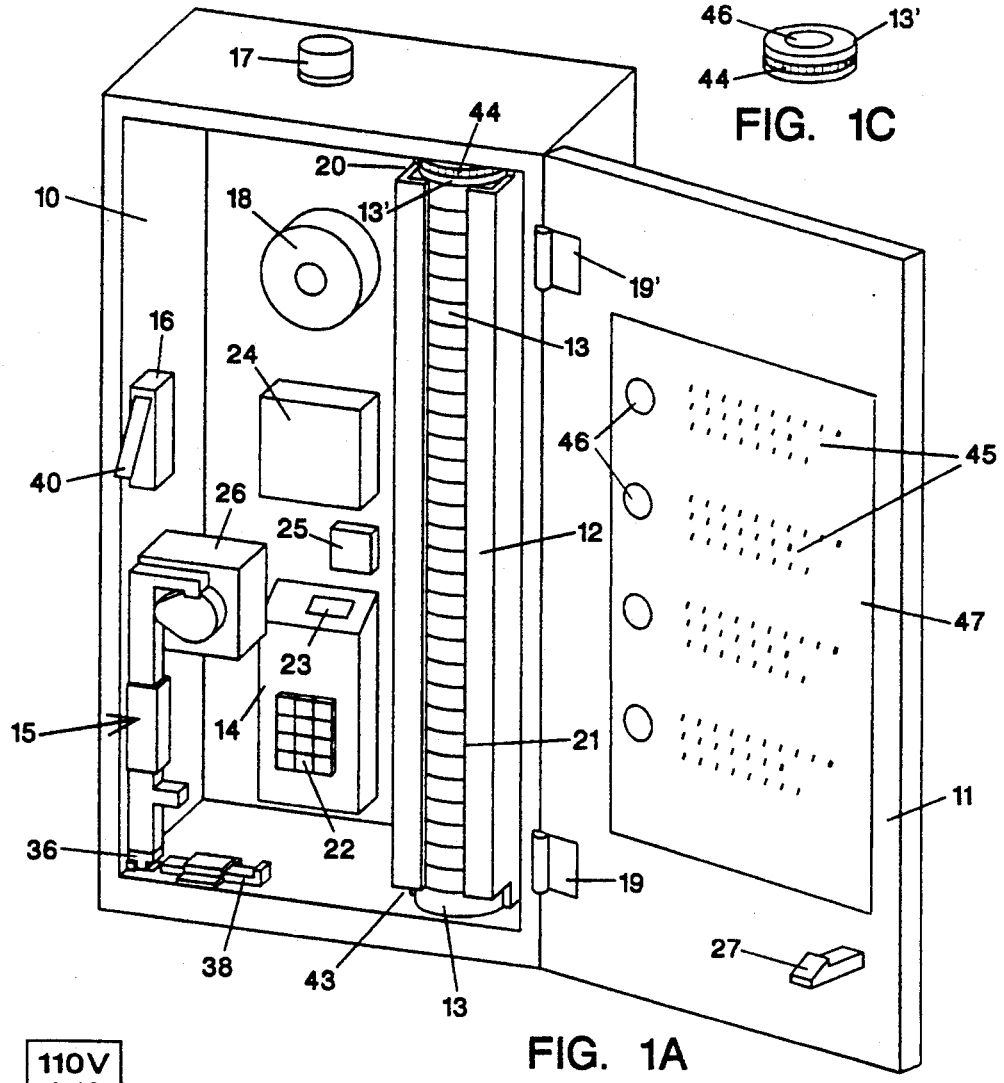
FIG. 1A
FIG. 1C
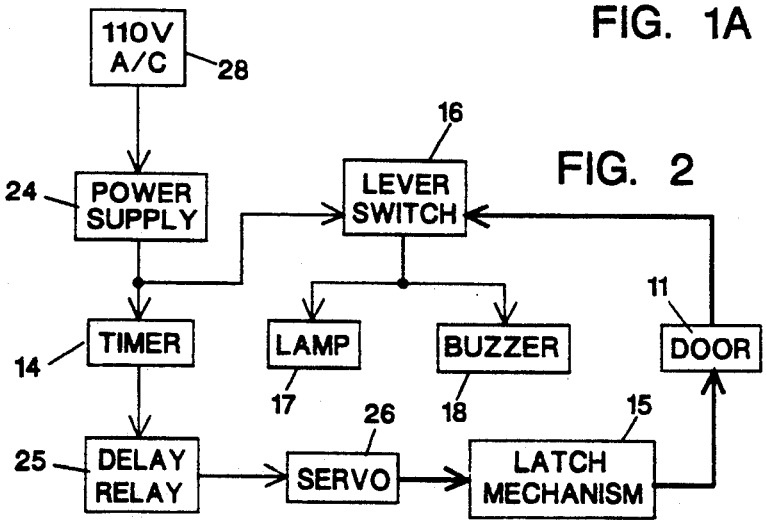
FIG. 2
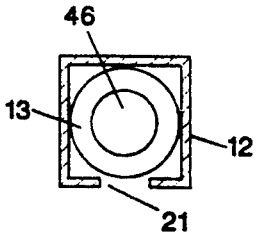
FIG. 1B

PROGRAMMABLE MEDICINE DISPENSER WITH MANUAL OVERRIDE AND COLOR CODED MEDICINE CANISTERS

FIELD OF THE INVENTION

This invention relates generally to medicine dispensers, specifically to a programmable medicine dispenser.

BACKGROUND OF THE INVENTION

A significant portion of our population takes prescribed medicine regularly for various illnesses. and conditions. Many of these people are sufficiently well to maintain all or enough of their faculties so that they are able to access and take their medication according to schedule. However, a great segment of these are elderly, or physically or mentally disabled. These people have great difficulty or are even unable to access or remember to take their medication. For example, the elderly often have a great deal of trouble opening the child-proof bottles mandated by the Poison Prevention Packaging Act of 1970, or they can completely forget to take their medicine at all. As a result, a caretaker is usually necessary to aid the elderly and the disabled in accessing their medication and maintaining their intake schedule. In hospitals, nursing homes, or some private homes, supervision and help are automatically provided by professional staff or able family members. However, this care can be inadequate or completely absent if the patients live alone or are visited infrequently by others. For whatever reason, failure to adhere to the prescription may at best slow recovery or allow a condition to go unchecked, or at worst it could be fatal.

These problems have prompted the development of various devices which attempt to provide solutions. U.S. Pat. Nos. 4,573,606 to Lewis et al. (1986) and 4,674,651 to Scidmore et al. (1987) show carousal pill dispensers with audio and visual alarms. Because these machines have enough capacity for only one day's supply of medication, they must be refilled daily by caretakers. U.S. Pat. No. 4,911,327 to Shepherd et al. (1990) shows a highly programmable device with multiple carousals, each of which holds one type of medicine. Although highly useful, the pill containers of this device have no locking mechanisms, therefore they are easily accessible by children. Moreover, it is highly complicated and therefore quite expensive to manufacture. As such, it is intended mainly for institutional use.

U.S. Pat. No. 3,563,410 to Murray (1971) shows a device with multiple, manually and independently operated dispensers. U.S. Pat. No. 3,752,359 to Shaw (1973) shows a device with manually operated sliding drawers which extract pills or pill bottles from magazines. Neither of these devices have a programmable timer or safety lockout, while both rely entirely on the user's ability to remember the proper dosage and schedule.

U.S. Pat. No. 4,731,765 to Cole et al. (1988) shows a programmable timer with pill receptacles for holding individual pills. Sensors in each receptacle detect the removal of the pills for triggering the timing interval. As such, this device can only hold pills of a predetermined physical size and shape, while it is limited to a single timing interval. Furthermore, although a solenoid operated latch mechanism safely locks the cabinet door until the set time is reached, presumably as a child proof measure, it is easily defeated by a front mounted and therefore plainly accessible override switch.

U.S. Pat. No. 3,369,697 to Glucksman et al. (1968) shows a timer operated medicine dispenser which automatically releases pill boxes from a tall, lockable magazine. Because the sealed magazine provides no external indication of its capacity, the machine can run out of medicine without warning. In addition, the padlocked magazine can prevent emergency access to the medicine in-between their timed releases if the key is lost.

U.S. Pat. No. 4,872,591 to Konopka (1989) shows a medicine dispenser with multiple magazines. One magazine will automatically dispense canisters once per day, another twice per day, another three times per day, etc. Because the magazines dispense canisters at different frequencies, some will be emptied days sooner than others, so that the dispenser could necessitate daily reloading. Moreover, the mechanical timing mechanism which controls the dispensing operations is inflexible: The dispensing intervals of each magazine are equal and fixed, so that it cannot be adjusted to take into account the long sleeping hours at night.

In conclusion, the references show devices which are either limited in capacity, expensive and complicated, lacking in flexibility to hold pills of different shapes, allow children easy access to their contents, cannot accurately and automatically dispense different medicines at different intervals, or can potentially lock out authorized users in emergencies.

SUMMARY OF THE INVENTION

Accordingly, several objects and advantages of the invention are to provide a programmable medicine dispenser with manual override and color coded medicine canisters which can hold enough medicine to supply a patient for many days, which can accurately supply the prescribed dosages and combination of dosages, which can be programmed to dispense medicine at multiple and scheduled intervals during the day, which provides audio and visual indicators to alert the patient of the time for taking medicine to ensure that it is taken, which prevents unauthorized access to its contents in-between timing intervals, which allows authorized persons access to its contents in-between timing intervals in emergencies, and which is simple and economical to manufacture.

Further objects and advantages will become apparent from a study of the following description and the accompanying drawings.

In a preferred embodiment of the invention, a programmable medicine dispenser with manual override and color coded medicine canisters comprises a cabinet with a spring loaded door. The door is held closed by a servo-operated latch mechanism to prevent unauthorized access to the contents. A vertical magazine within the cabinet holds a large number of canisters, each sequentially containing doses or combination of doses of medicine to be taken at sequentially programmed times. The canisters are color coded by pressure sensitive patches in several colors, and stacked in a repeated order, such that each color coded canister in each repeated order corresponds to and visually indicates a certain scheduled medication time during a day.

A multiple event, programmable timer mounted inside the cabinet activates, through a delay relay, the servo-operated latch mechanism to open the door. When the door springs open, it disengages from and activates a normally closed lever switch, which turns on an indicator lamp and a buzzer to alert the patient or a caretaker that a scheduled time for taking medicine has been reached. A canister containing the scheduled dose may then be removed from the bottom of the magazine through a dispensing port. When it is emptied, the canister is replaced into the magazine through a top loading port, such that the canisters are cycled sequentially and downwardly through the magazine without disturbing the sequence or order of the color coded canisters.

During medical emergencies when access to the medicine within the cabinet is urgently needed, the door may be opened in-between preprogrammed opening times by pressing a manual override pin under the cabinet. The pin operates the latch mechanism independently of the servo to open the door. If desired, the override may be disabled by sliding a lockout bar into engagement with the pin. This ensures that the door cannot be opened until the next preprogrammed opening time.

BRIEF DESCRIPTION OF THE DRAWINGS

FIG. 1A is a perspective view of the programmable medicine dispenser with manual override and color coded medicine canisters in accordance with a preferred embodiment of the invention.

FIG. 1B is a top sectional view of the magazine of FIG. 1A.

FIG. 1C is a perspective view of a medicine canister of FIG. 1A.

FIG. 2 is a block diagram of the electrical circuit and the mechanisms of the dispenser of FIG. 1A.

Figure 3A:
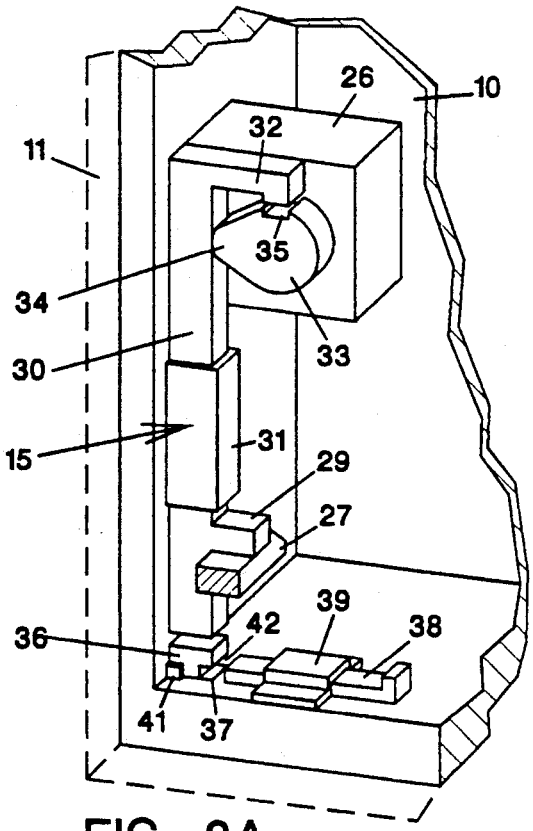
FIGS. 3A to 3D are partial cutaway perspective views of the servo-operated latch mechanism of FIG. 1A, showing the sequence of operation.

| Drawing Reference Numerals | |
|---|---|
| 10. Cabinet | 11. Door |
| 12. Magazine | 13. Canister |
| 14. Electronic Timer | 15. Latch Mechanism |
| 16. Lever Switch | 17. Lamp |
| 18. Buzzer | 19. Spring Loaded Hinge |
| 20. Loading Port | 21. Open Channel |
| 22. Keypad | 23. Digital Display |
| 24. Power Supply | 25. Delay Relay |
| 26. Servo | 27. Door Latch |
| 28. AC Supply | 29. Extension |
| 30. Rod | 31. Rod Bracket |
| 32. Cam Follower | 33. Cam |
| 34. Cam Lobe | 35. Notch |
| 36. Override Pin | 37. Hole |
| 38. Lockout Bar | 39. Lockout Bar Bracket |
| 40. Lever | 41. Nub |
| 42. Notch | 43. Dispensing Port |
| 44. Rubber Band | 45. Legend |
| 46. Colored Patch | 47. Placard |

DESCRIPTION—FIGS. 1A TO 1C

In accordance with a preferred embodiment of the invention shown in FIGS. 1A to 1C, a programmable medicine dispenser with manual override and color coded medicine canisters comprises a cabinet 10 with a door 11, a magazine 12 for holding a large number of medicine canisters 13, an electronic timer 14 for controlling a door latch mechanism 15, and a lever switch 16 for controlling indicator lamp 17 and buzzer 18. Lamp 17 is mounted on the top side of cabinet 10.

Cabinet 10 is a rectangular box having door 11 (shown in the opened position) attached to the right side with spring loaded hinges 19 and 19', which tend to keep the door fully opened. A hook-shaped door latch 27 having a beveled front end is attached to a lower corner of the inside of door 11. The door is normally latched closed, which operation will be subsequently explained, to prevent unauthorized access to the contents of cabinet 10. However, the door may be opened in emergencies by using an override pin 36 to manually operate door latch mechanism 15. Optionally, override pin 36 may be disabled by a lockout bar 38. The details of these operations will be explained later.

Magazine 12 is a vertically elongated box with a square cross section for holding a large number of medicine canisters 13. Magazine 12 extends between the top and bottom sides of cabinet 10, and has a loading port 20 and a dispensing port 43 at the top and bottom portions, respectively, of its front face. The ports are rectangular cutouts sized and shaped for allowing the passage of canisters 13. An open channel 21 spans the length of the front side of magazine 12 to make visible the entire stock of canisters 13.

Electronic timer 14, mounted within cabinet 10, is a conventional and inexpensive multiple event programmable timer currently available from Radio Shack stores around the country. It contains a relay (not shown) which can be set to supply power to an external device for at least one minute per event for up to four times a day, each time being independently programmable through a keypad 22 and shown on a digital display 23. Therefore, timer 14 may be set to trigger at programmed intervals to suit any medication as well as sleep schedules. For example, timer 14 may be set to activate for one minute at 8 AM, 12:00 Noon, 4:00 PM, and 8:00 PM. The number of programmable events is large enough to accommodate most prescription schedules. Additional and conventional electrical components mounted within cabinet 10 includes a power supply 24, a delay relay 25, and a servo 26, which will be explained infra.

Lever switch 16 is mounted on a side wall of cabinet 10, slightly behind the plane of the cabinet's opening. Normally closed switch 16 is controlled by a spring loaded lever 40 which normally extends outside the cabinet's opening when door 11 is opened. When door 11 is closed, it will fully compress lever 40 to open the contacts (not shown) of the switch.

Each container or canister 13 may be loaded with a dose of medicine (not shown), or any combination of medication prescribed for the patient for a single period of time. The number of canisters 13 provided is large enough to contain one or more week's supply of medication. Canisters 13 are color coded with pressure sensitive, colored patches 46 such that each canister 13 may be identified according to the daily medication schedule or sequence. For example, yellow may be used for identifying canisters containing medicine to be used daily at 8:00 AM, red for 12:00 Noon, green for 4:00 PM, and blue for 8:00 PM. Legends 45 with corresponding colored patches 46 are printed on a placard 47, which is mounted inside door 11, to identify the medicine and times associated with each color of colored patches 46. Placard 47 is made of a matte finished material such as acetate or aluminum for easy correction, update or modification. Additional space is available on placard 47 for supplemental instructions or precautions (not shown).

The medicine dispenser may be loaded by filling all but one of canisters 13 with the proper medicine. The filled canisters are inserted into loading port 20 one at a time and allowed to fall down magazine 12. The first canister 13 to be loaded and therefore the lowest canister in the magazine contains medicine to be taken at the next scheduled time. Subsequent canisters containing subsequent doses are loaded into magazine 13 in the order at which the doses are to be taken. For the example schedule previously described, the loading sequence will be: Yellow, Red, Green, Blue (Day 1); Yellow, Red, Green, Blue (Day 2); Yellow, Red, etc. The color coding provides positive visual indication to assure the user that the correct order and times of the prescriptions are being properly followed. An empty and marked canister 13', made distinctive by being encircled with a wide rubber band 44, is inserted into magazine 12 after the last filled canister 13 to mark the end of the filled stack of canisters.

DESCRIPTION—FIG. 2

Timer 14 is connected to an electro-mechanical circuit for controlling the operation of the medicine dispenser. Because the circuitry is very simple, it will be readily understood by anyone skilled in the art.

Power supply 24 is preferably a suitable battery, which will enable portability of the dispenser and immunity to power disruptions, or it may optionally be a conventional voltage converter circuit connected to a 110 V AC source 28 such as a household electrical wall socket. In either case, power supply 24 supplies DC power to the other electrical components in the medicine dispenser. Power supply 24 is electrically connected to and powers electronic timer 14.

Electronic timer 14 may be programmed as described in FIGS. 1A to 1C. When a programmed activation time is reached, electronic timer 14 will supply power, for one minute, from power supply 24 to delay relay 25. The conventional delay relay uses an internal circuit (not shown) to delay activation of its contacts (not shown) for 58.5 seconds, such that the contacts will be closed for only 1.5 seconds at the end of the one minute output of electronic timer 14. When the contacts are made, delay relay 25 supplies power from power supply 24, through timer 14, to servo 26, which is geared to rotate one revolution per second. The servo mechanically operates latch mechanism 15, the details of which will be subsequently explained. Latch mechanism 15 mechanically releases door 11, which springs open to permit access to the contents of cabinet 10 (FIGS. 1A to 1C). When door 11 is opened, it mechanically activates lever switch 16 as described in FIGS. 1A to 1C to supply power from power supply 24 to indicator lamp 17 and buzzer 18. The lamp and buzzer positively alert the patient or a caretaker that a time to take medicine has been reached.

OPERATION—FIGS. 1A TO 1C

After door 11 has automatically opened at a programmed time, as described in FIG. 2, the user can remove the canister 13 containing the currently scheduled medication from the bottom of the stack through dispensing port 43. After the canister is emptied of its medicine, it is to be replaced into magazine 12 through top loading port 20 so that it rests at the top of the stack, above marked canister 13'. Therefore, canisters 13 will be cycled downwardly within magazine 12 as more and more canisters are emptied and replaced to the top of the stack. Those canisters 13 below marked canister 13' are loaded with medicine, while those canisters 13 which will be placed above marked canister 13' will be empty. Therefore, marked canister 13' will travel downwardly within magazine 12 to provide a visual indication of the number of scheduled doses left in the magazine. Each opening of door 11 is an opportunity for the user to inspect the stock and condition of canisters 13 through channel 21. When marked canister 13' reaches the bottom of the stack, the patient or the caretaker will be alerted to the need for refilling all the canisters.

DESCRIPTION—FIGS. 3A TO 3D

The structure and operation of latch mechanism 15, which includes a rod 30, a rod bracket 31, a cam follower 32, and a side extension 29, will now be explained in detail. Referring to FIG. 3A, door 11 is normally closed by having hook-shaped door latch 27 engage side extension 29 of square rod 30. The rod is vertically and slidably mounted on the wall of cabinet 10 by rod bracket 31 attached to the cabinet. Rod 30 is generally in the shape of an inverted "J", the top end of which terminates in cam follower 32 positioned above a cam 33 attached to the output shaft (not shown) of servo 26. Cam 33 is shown in the normal position of having a cam lobe 34 at the nine o'clock position. The cam has a notch 35 directly under and spaced from the distal end of cam follower 32. Square override pin 36 is disposed through a square hole 37 on the bottom side of cabinet 10, directly under and spaced slightly from the lower end of rod 30. A nub 41 protruding from the side of override pin 36 prevents the pin from falling through hole 37. Override lockout bar 38 is slidably mounted adjacent to a notch 42 on pin 36 by a lockout bar bracket 39 attached to cabinet 10. The hidden location of pin 36 on the underside of cabinet 10 provides some measure of security against the unauthorized use of the override. The override pin and its lockout will be explained later in FIGS. 4A and 4B.

Figure 3B:
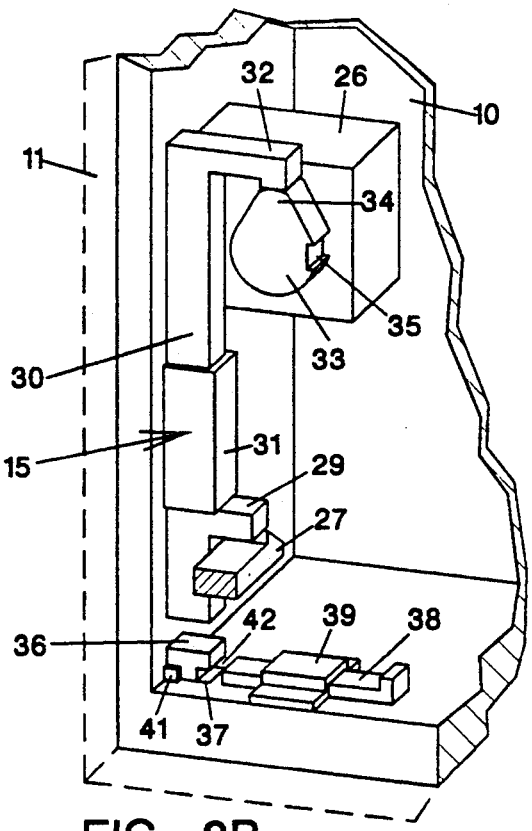

Referring to FIG. 3B, when servo 26 is activated by timer 14 and delay relay 25 (FIGS. 1A and 2) at a preprogrammed time as described in FIG. 2, cam 33 will rotate clockwise. When cam lobe 34 is at the twelve o'clock position as shown, it will lift cam follower 32, rod 30, and side extension 29 upwardly such that the extension is moved away from engaging door latch 27. No longer constrained by the door latch, spring loaded hinges 19 and 19' (FIG. 1A) will swing door 11 open. Referring to FIG. 1A, when the door is opened as shown, lever 40 of switch 16 will spring out, which closes the switch to activate lamp 17 and buzzer 18 as described in FIG. 2. The patient or the caretaker is thus positively alerted to the need to take medication.

Figure 3C:
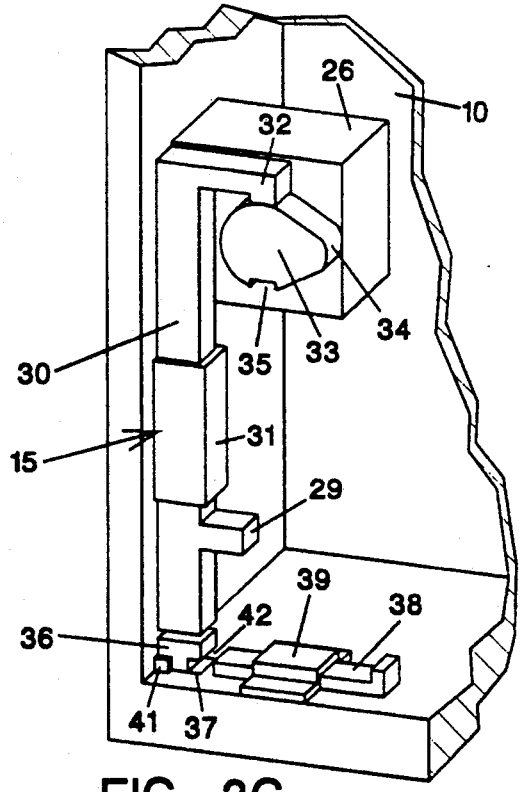

Referring to FIG. 3C, cam 33 will continue to rotate as servo 26 is kept energized by delay relay 25 (FIGS. 1A and 2). As cam lobe 34 rotates completely past cam follower 32, the follower and rod 30 will be caused by gravity to lower slightly.

Figure 3D:
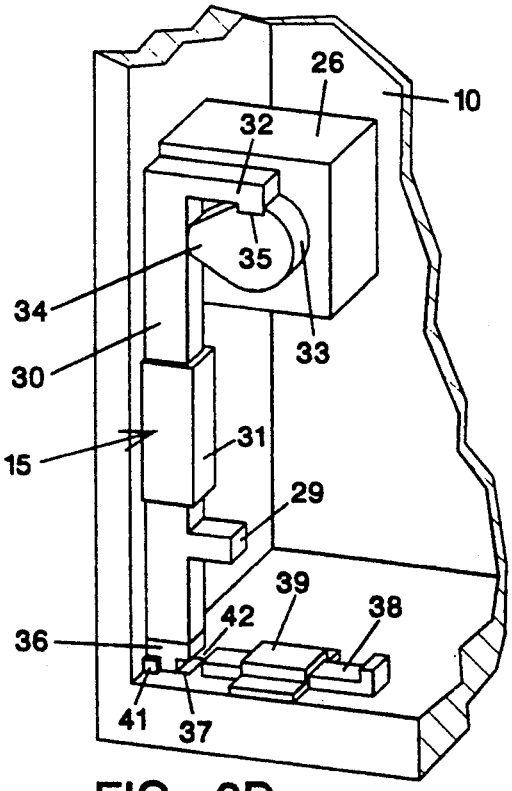

Referring to FIG. 3D, cam 33, which rotates at one revolution per second, must return to its starting position as shown in FIG. 3A prior to the end of the 1.5 second output duration of delay relay 25 (FIGS. 1A and 2). This is accomplished by notch 35 on cam 33: When cam lobe 34 reaches the nine o'clock position, the distal end of cam follower 32 will fall into notch 35 to prevent further rotation of the cam as shown. This ensures that the cam will always return to the same position.

After the medicine has been taken as described in FIGS. 1A to 1C, the user will close door 11. When door latch 27 inside door 11 contacts extension 29 of rod 30, the beveled front end of the latch will push the extension and the rod upwardly until the extension falls behind and engages the hook portion of the latch, which locks the door closed, as shown in FIG. 3A. The upwardly displacement of rod 30 also lifts cam follower 32 away from notch 35, so that cam 33 will be free to rotate at the next activation time. When door 11 is closed, it will compress lever 40 of switch 16 to turn off lamp 17 and buzzer 18 (FIG. 1A).

DESCRIPTION—FIGS. 4A AND 4B

During medical emergencies, the patient might need to take the medicine stored within cabinet 10 in-between the programmed opening times of door 11. Therefore, override pin 36 is provided for manually opening the door.

Figure 4A:
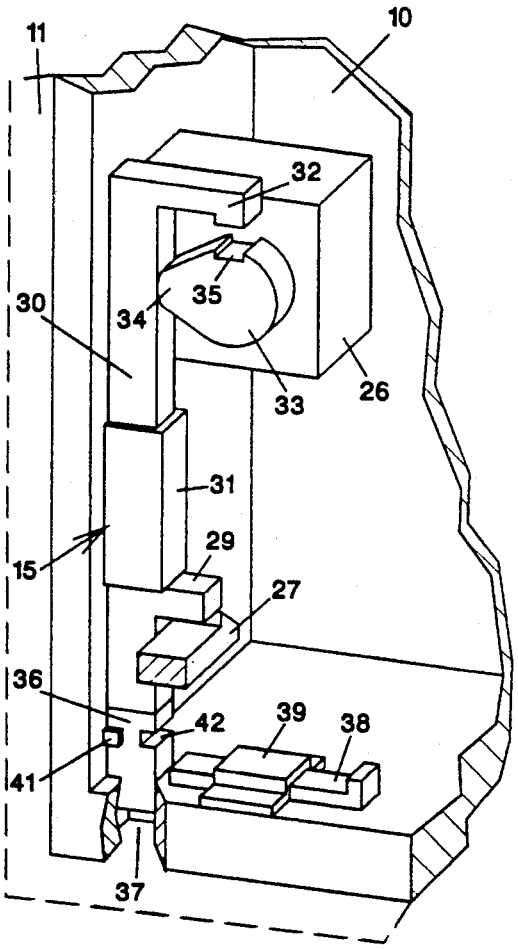
FIGS. 4A and 4B are partial cut away perspective views showing the operation of the manual override and override lockout mechanisms of FIG. 1A.

Referring to FIG. 4A, when access to the medicine within cabinet 10 is desired, the cabinet is tilted backwards or lifted slightly so that the user may push pin 36 upwardly against the bottom end of bar 30 to lift the bar and extension 29 away from engaging door latch 27, as shown. Door 11 will then swing open under the tension of spring-loaded hinges 19 and 19' (FIG. 1A).

Figure 4B:
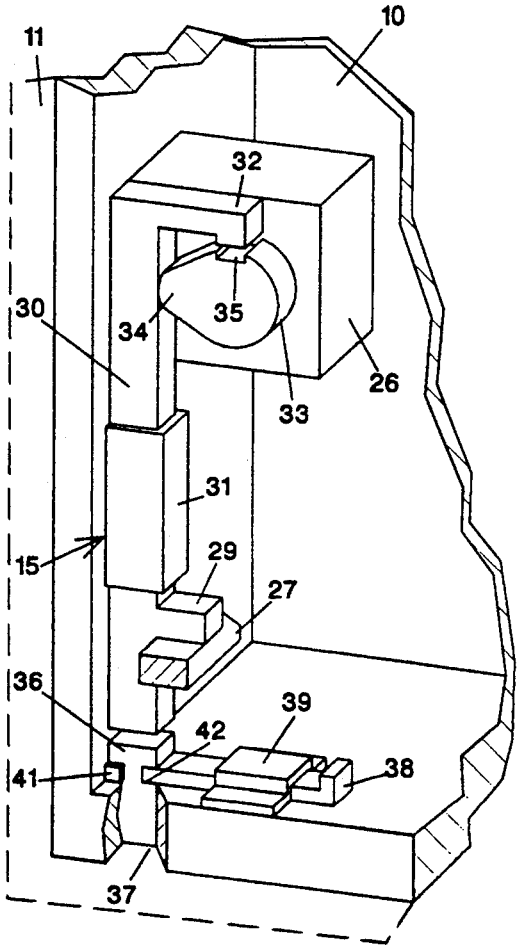

Override pin 36 may optionally be disabled by sliding lockout bar 38 into engagement with notch 42 of the pin to lock the pin in position, as shown in FIG. 4B. This may be desirable as an added and positive precaution against unauthorized use or curious children, who could potentially be poisoned by the medicine within the dispenser. When locked in this manner, door 11 cannot be opened until the next programmed opening time.

Thus the reader will see that I have provided a programmable medicine dispenser with color coded medicine canisters which can hold enough medicine to supply a patient for many days, which can accurately supply the prescribed dosages and combination of dosages, which can be programmed to dispense medicine at multiple and scheduled intervals during the day, which provides audio and visual indicators to alert the patient of the time for taking medicine to ensure that it is taken, which prevents unauthorized access to its contents in-between timing intervals, which allows authorized persons access to its contents in-between timing intervals in emergencies, and which is simple and economical to manufacture.

While the above descriptions are specific, they should not be considered as limitations on the scope of the invention, but only as examples of the embodiments. Many other ramifications and variations are possible within the teachings of the invention. For example, delay relay 25 may be eliminated by using a timer which produces an output suitably short in duration. Lamp 17 may be eliminated without any loss in the medicine dispenser's ability to alert the user. Thus, the reader is requested to determine the scope of the invention by the appended claims and their legal equivalents, and not by the examples given.

I claim:

1. A medicine dispenser, comprising:

a cabinet, a plurality of canisters for holding medication, said canisters being divided into a plurality of groups, each of said groups having a predetermined number of said canisters, color coding means for differentiating each of said canisters within each of said groups, an elongated magazine vertically housed within said cabinet for sequentially storing said groups of said canisters in a vertical stack, said elongated magazine having a top end and a bottom end, said canisters in each of said groups being arranged in a predetermined sequence, said elongated magazine having a loading port at said top end for allowing the loading of said canisters, said elongated magazine having a dispensing port at said bottom end for allowing the removal of said canisters, signaling means for alerting a person to remove one of said canisters from said dispensing port of said elongated magazine, and timing means for operating said signaling means at selectable time intervals.

2. The medicine dispenser of claim 1 wherein said signaling means comprises a buzzer.

3. The medicine dispenser of claim 1 wherein said signaling means comprises a lamp and a buzzer.

4. The medicine dispenser of claim 1 wherein said timing means comprises a multiple event programmable electronic timer.

5. The medicine dispenser of claim 1, further including a door having a plurality of springloaded hinges attached to said cabinet, and a latching means responsive to said timing means for locking and unlocking said door at said selectable time intervals.

6. The medicine dispenser of claim 5, further including an override means for allowing manual operation of said latching means independently of said timing means, and an override lockout means for allowing the optional disabling of said override means.

7. The medicine dispenser of claim 5 wherein said latching means comprises:

a latch attached to said door, a vertical bar slidably attached within said cabinet, said bar having a side extension for engaging said latch for normally locking said door closed, and electro-mechanical means responsive to said timing means for lifting said bar and said side extension away from engaging said latch for unlocking said door.

8. The medicine dispenser of claim 1, further including a plurality of legends attached to said cabinet, and a plurality of labels for labeling said canisters, each of said labels corresponding to one of said legends for identifying said medication within said canisters.

9. The medicine dispenser of claim 1, further including marking means disposed among said vertical stack of said canisters for identifying said canisters below said marking means as being loaded with said medication.

10. A medicine dispenser, comprising:

a cabinet having a door, a plurality of canisters for holding medication, said canisters being divided into a plurality of groups, each of said groups having a predetermined number of said canisters, color coding means for differentiating each of said canisters within each of said groups, an elongated magazine vertically housed within said cabinet for sequentially storing said groups of said canisters in a vertical stack, said elongated magazine having a top end and a bottom end, said canisters in each of said groups being arranged in a predetermined sequence, said elongated magazine having a loading port at said top end for allowing the loading of said canisters, said elongated magazine having a dispensing port at said bottom end for allowing the removal of said canisters, electro-mechanical latching means for normally locking said door closed for preventing access to said canisters, a programmable electronic timer for oeprating said electro-mechanical latching means at selectable time intervals for opening said door, signaling means responsive to said opening of said door for alerting a person to remove one of said canisters from said dispensing port of said elongated magazine, override means for allowing the manual operation of said electro-mechanical latching means independently of said programmable electronic timer, and override lockout means for allowing the optional disabling of said override means.

11. The medicine dispenser of claim 10 wherein said signaling means comprises a buzzer.

12. The medicine dispenser of claim 10 wherein said signaling means comprises a lamp and a buzzer.

13. The medicine dispenser of claim 10 wherein said programmable electronic timer comprises a multiple event programmable electronic timer.

14. The medicine dispenser of claim 10 wherein said electro-mechanical latching means comprises:

a latch attached to said door, a vertical bar slidably attached within said cabinet, said bar having a side extension for engaging said latch for normally locking said door closed, and electro-mechanical lifting means responsive to said programmable electronic timer for lifting said bar and said side extension away from engaging said latch for unlocking said door.

15. A medicine dispenser, comprising:

a cabinet having at least a bottom surface and a door, a plurality of canisters for holding medication,said canisters being divided into a plurality of groups, each of said groups having a predetermined number of said canisters, color coding means for differentiating each of said canisters within each of said groups, an elongated magazine vertically housed within said cabinet for sequentially storing said groups of said canisters in a vertical stack, said elongated magazine having a top end and a bottom end, said canisters in each of said groups being arranged in a predetermined sequence, said elongated magazine having a loading port at said top end for allowing the loading of said canisters, said elongated magazine having a dispensing port at said bottom end for allowing the removal of said canisters, a latch attached to said door, a vertical bar slidably attached within said cabinet, said bar having a side extension for engaging said latch for normally locking said door closed, electro-mechanical lifting means for lifting said bar and said side extension away from engaging said latch for unlocking said door, a programmable electronic timer for operating said electro-mechanical lifting means at selectable time intervals for unlocking said door for allowing access to said canisters, signaling means responsive to said unlocking of said door for alerting a person to remove one of said canisters from said dispensing port of said elongated magazine, an override pin disposed through said bottom surface of said cabinet, said override pin being positioned under said vertical bar, said override pin having a notch, such that when said override pin is pushed upwardly, said override pin will engage and lift said vertical bar and said side extension away from engaging said latch of said door for unlocking said door independently of said programmable electronic timer, and an override lockout bar slidably positioned adjacent said override pin, such that said override lockout bar may be slidably positioned into engagement with said notch of said override pin for optionally disabling said override pin.

16. The medicine dispenser of claim 15 wherein said signaling means comprises a buzzer.

17. The medicine dispenser of claim 15 wherein said signaling means comprises a lamp and a buzzer.

18. The medicine dispenser of claim 15 wherein said programmable electronic timer comprises a multiple event programmable electronic timer.

19. The medicine dispenser of claim 15, further including a plurality of legends attached to said cabinet, and a plurality of labels for labeling said canisters, each of said labels corresponding to one of said legends for identifying said medication within said canisters.

20. The medicine dispenser of claim 15, further including marking means disposed among said vertical stack of said canisters for identifying said canisters below said marking means as being loaded with said medication.

* * * * *